US009764344B1

(12) United States Patent
Franklin

(10) Patent No.: US 9,764,344 B1
(45) Date of Patent: Sep. 19, 2017

(54) BOTTLE AND SPRAY ASSEMBLY

(71) Applicant: Antione Franklin, Hayward, CA (US)

(72) Inventor: Antione Franklin, Hayward, CA (US)

( * ) Notice: Subject to any disclaimer, the term of this patent is extended or adjusted under 35 U.S.C. 154(b) by 72 days.

(21) Appl. No.: 14/834,964

(22) Filed: Aug. 25, 2015

Related U.S. Application Data

(63) Continuation-in-part of application No. 13/585,032, filed on Aug. 14, 2012, now abandoned.

(51) Int. Cl.
*B05B 11/00* (2006.01)
*B05B 15/00* (2006.01)

(52) U.S. Cl.
CPC ..... *B05B 11/3001* (2013.01); *B05B 11/3011* (2013.01); *B05B 11/3014* (2013.01); *B05B 15/005* (2013.01)

(58) Field of Classification Search
CPC ..... B05B 11/3001; B05B 11/3011; B05B 11/3014; B05B 15/005
USPC ..... 239/153
See application file for complete search history.

(56) References Cited

U.S. PATENT DOCUMENTS 2,258,869 A * 10/1941 Towart, Jr. ..... A62C 13/003 116/205
2,393,346 A * 1/1946 Stroop ..... A62C 37/50 116/271
3,730,390 A * 5/1973 Adrian ..... F41H 9/10 222/402.13
3,744,717 A * 7/1973 Kozub ..... B65D 83/205 239/1
4,223,804 A * 9/1980 Morris ..... B65D 83/201 116/214
4,402,430 A * 9/1983 Fox ..... F41H 9/10 222/183
6,223,380 B1 5/2001 Klima
6,227,740 B1 5/2001 Stear
6,305,619 B1 * 10/2001 Thurn ..... A01M 21/043 222/175
6,742,951 B2 6/2004 Schultz
7,040,510 B1 5/2006 Hester
2005/0229284 A1 10/2005 Gaetz
2005/0229349 A1 10/2005 Foser
2009/0256004 A1 10/2009 Hornsby

* cited by examiner

*Primary Examiner* — Chee-Chong Lee

(57) ABSTRACT

The bottle and spray assembly is a device that is designed pump liquids through a nozzle. The pump of the bottle and spray assembly is manually operated. The bottle and spray assembly is designed to rest on the arm of the user while the user holds a handle. The placement of bottle and spray assembly is in such a manner that the arm holds the bottle and spray assembly in place while the user pulls on the handle. The motion of pulling the handle operates the pump action within the spray assembly, which pumps the liquid through a nozzle. The bottle and spray assembly comprises a bottle and a spray assembly.

4 Claims, 7 Drawing Sheets

BOTTLE AND SPRAY ASSEMBLY

CROSS REFERENCES TO RELATED APPLICATIONS

This continuation-in-part patent application claims the benefit of priority to the non-provisional patent application Ser. No. 13/585,032 that was filed on Aug. 14, 2012.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sprayer designs and spray gun designs, more specifically, a spray bottle adapted to be supported by the arm of the user.

SUMMARY OF INVENTION

The bottle and spray assembly is a device that is designed pump liquids through a nozzle. The pump of the bottle and spray assembly is manually operated. The bottle and spray assembly is designed to rest on the arm of the user while the user holds a handle. The placement of bottle and spray assembly is in such a manner that the arm holds the bottle and spray assembly in place handle operates the pump action within the spray assembly, which pumps the liquid through a nozzle.

These together with additional objects, features and advantages of the bottle and spray assembly will be readily apparent to those of ordinary skill in the art upon reading the following detailed description of the presently preferred, but nonetheless illustrative, embodiments when taken in conjunction with the accompanying drawings.

In this respect, before explaining the current embodiments of the bottle and spray assembly in detail, it is to be understood that the bottle and spray assembly is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bottle and spray assembly.

It is therefore important that the claims be regarded as including such equivalent construction insofar as they do not depart from the spirit and scope of the bottle and spray assembly. It is also to be understood that the phraseology and terminology employed herein are for purposes of description and

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

Figure 1:
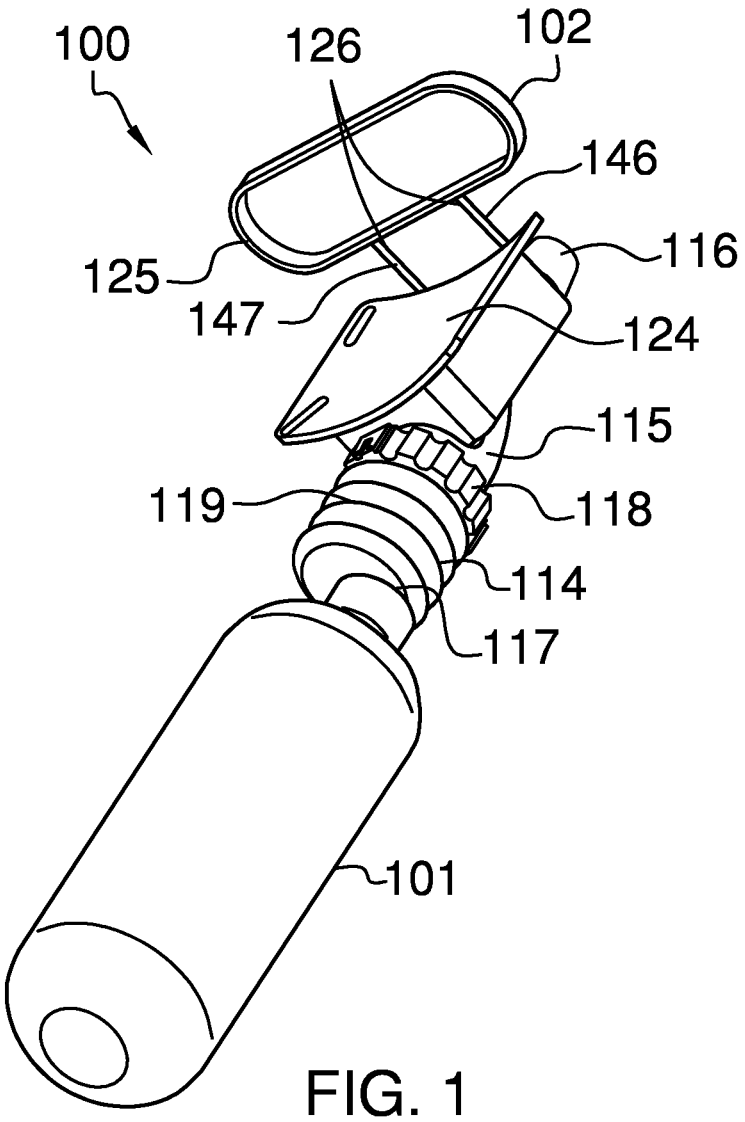
FIG. 1 is a perspective view of an embodiment of the disclosure.
Figure 2:
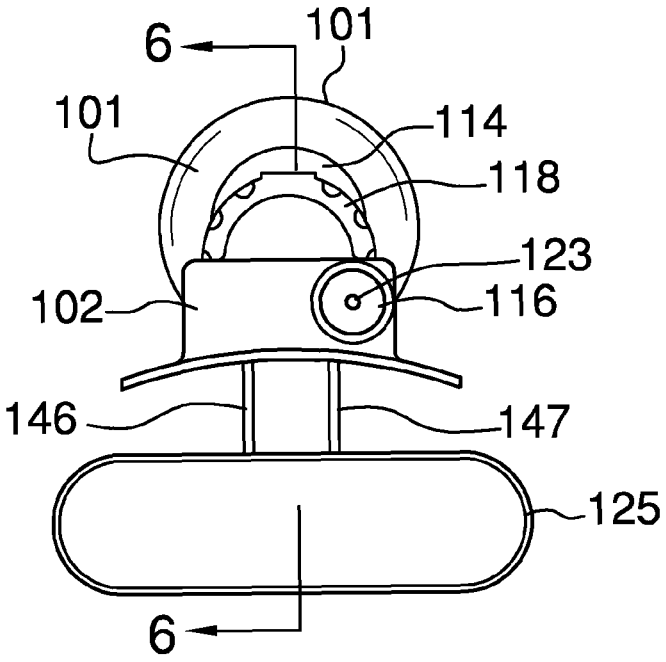
FIG. 2 is a front view of an embodiment of the disclosure.
Figure 3:
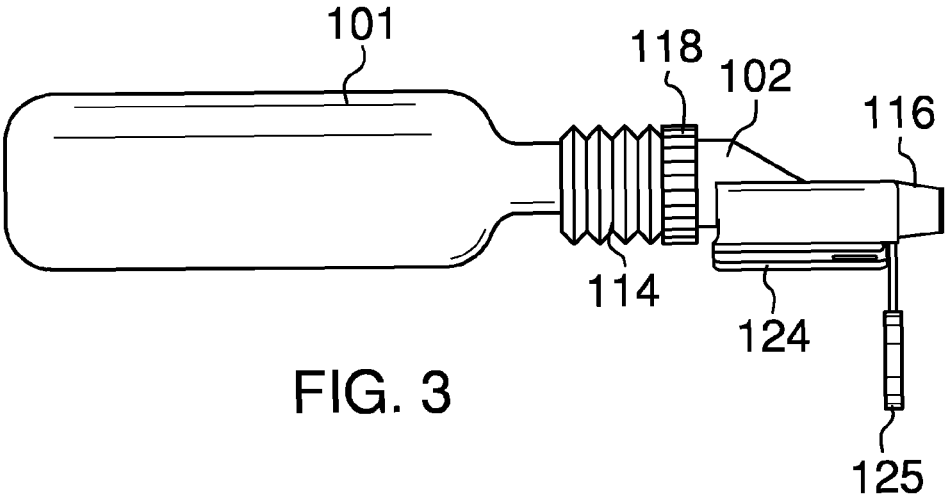
FIG. 3 is a side view of an embodiment of the disclosure.
Figure 4:
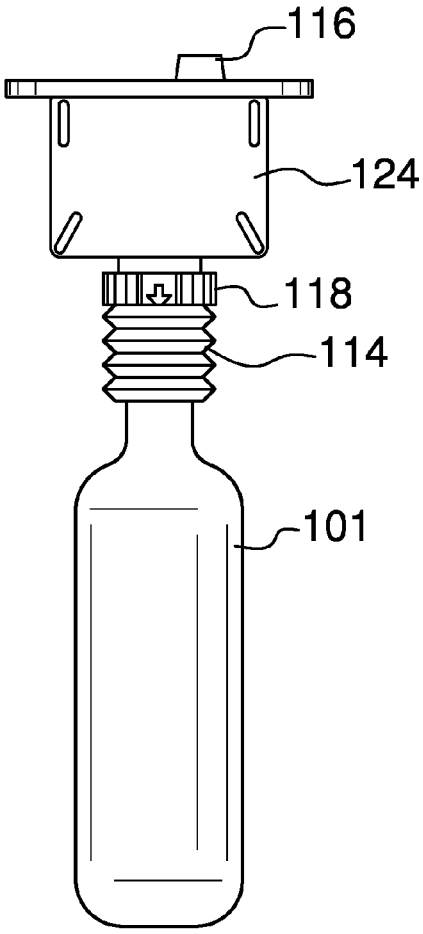
FIG. 4 is a bottom view of an embodiment of the disclosure.
Figure 5:
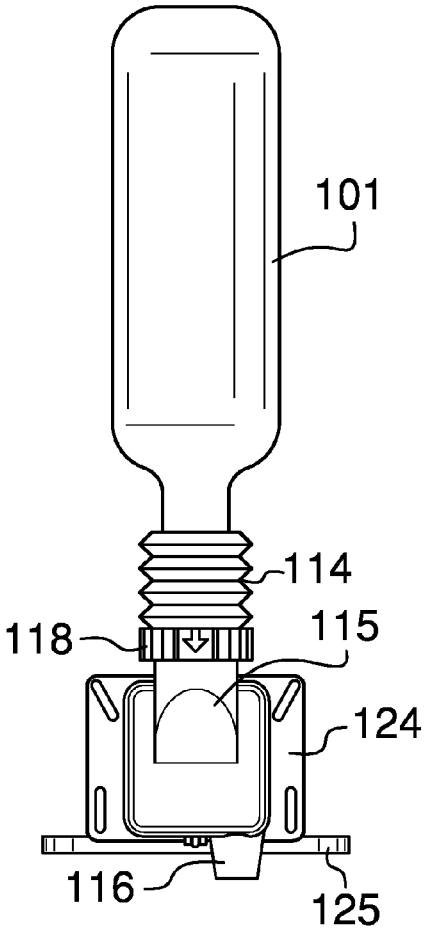
FIG. 5 is a top view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 9. The bottle and spray assembly 100 (hereinafter invention) comprises a bottle 101 and a spray assembly 102.

The bottle 101 is a container that is used for holding liquids 131. The bottle 101 further comprises a threaded bottle that is formed in the bottle 101 to allow for liquids 131 to be placed into and removed from the bottle 101. The exterior surface of the threaded bottle neck 111 is formed with an exterior screw thread.

The spray assembly 102 is used to distribute the liquid 131 contained within the bottle 101 by pumping the liquid 131 through a nozzle 123. The spray assembly 102 further comprises a reservoir tube 112, a nozzle tube 113, an adapter 114, a spray channel 115, a tip 116, a back of hand rest 124, and a handle 125. The reservoir tube 112 is a tube that is used to draw the liquid 131 out of the bottle 101 and to conduct the liquid 131 to the spray channel 115. The nozzle tube 113 is tube that is used to conduct the liquid 131 that has been drawn out of the bottle 101 through the spray channel 115 to the tip 116. The nozzle tube 113 is made from an elastic material that will deform under pressure but regains its shape when the pressure is removed. The method of connecting the reservoir tube 112 to the nozzle tube 113 is discussed elsewhere in this disclosure. The adapter 114 is a device that is used to connect the bottle 101 to the spray assembly 102. The spray channel 115 is a hollow cylinder that contains the pump mechanism that is used to draw liquid 131 out of the bottle 101 and transport the liquid 131 drawn out of the bottle 101 to the tip 116. The tip 116 is a device that discharges the liquid 131 that has been drawn out of the bottle 101. The back of hand rest 124 is a curved structure that is adapted to rest on the back of the hand 132 of a user. The purpose of the back of hand rest 124 is to hold the invention 100 securely against the arm 132. The handle 125 is a hand grip that is grasped by the hand 133. The purpose of the handle 125 is to both hold the invention 100 securely and to operate the pump mechanism of the invention 100.

Figure 6:
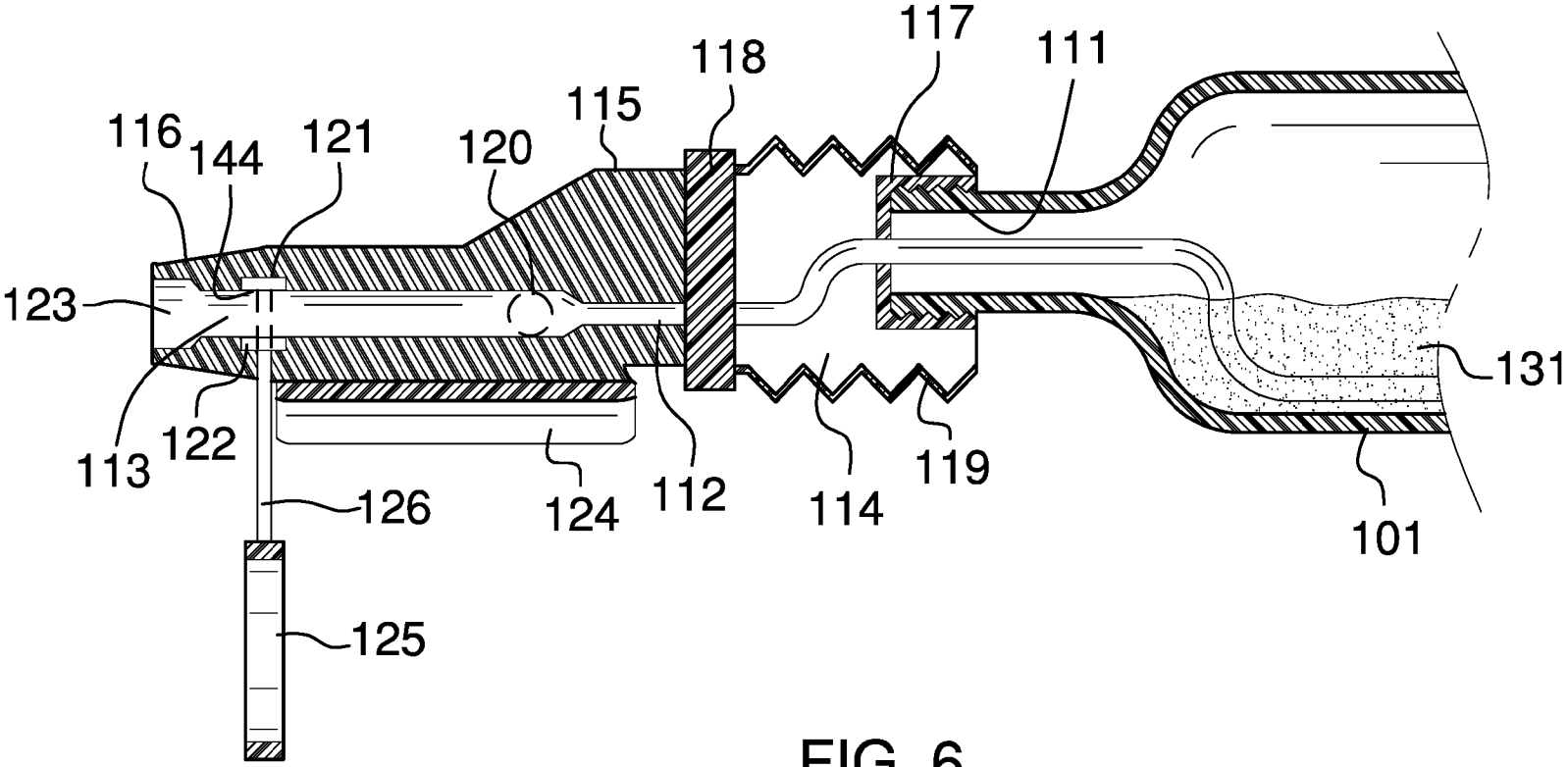
FIG. 6 is a cross-sectional view of an embodiment of the disclosure across 6-6.
Figure 7:
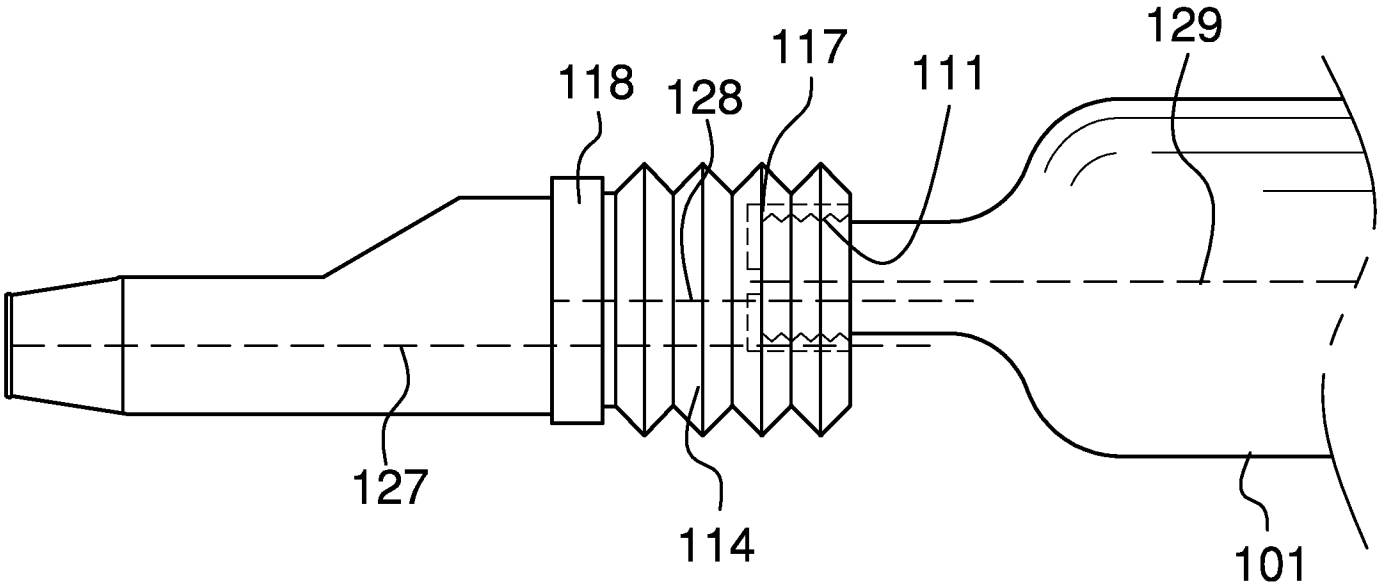
FIG. 7 is a detail view of an embodiment of the disclosure.
Figure 8:
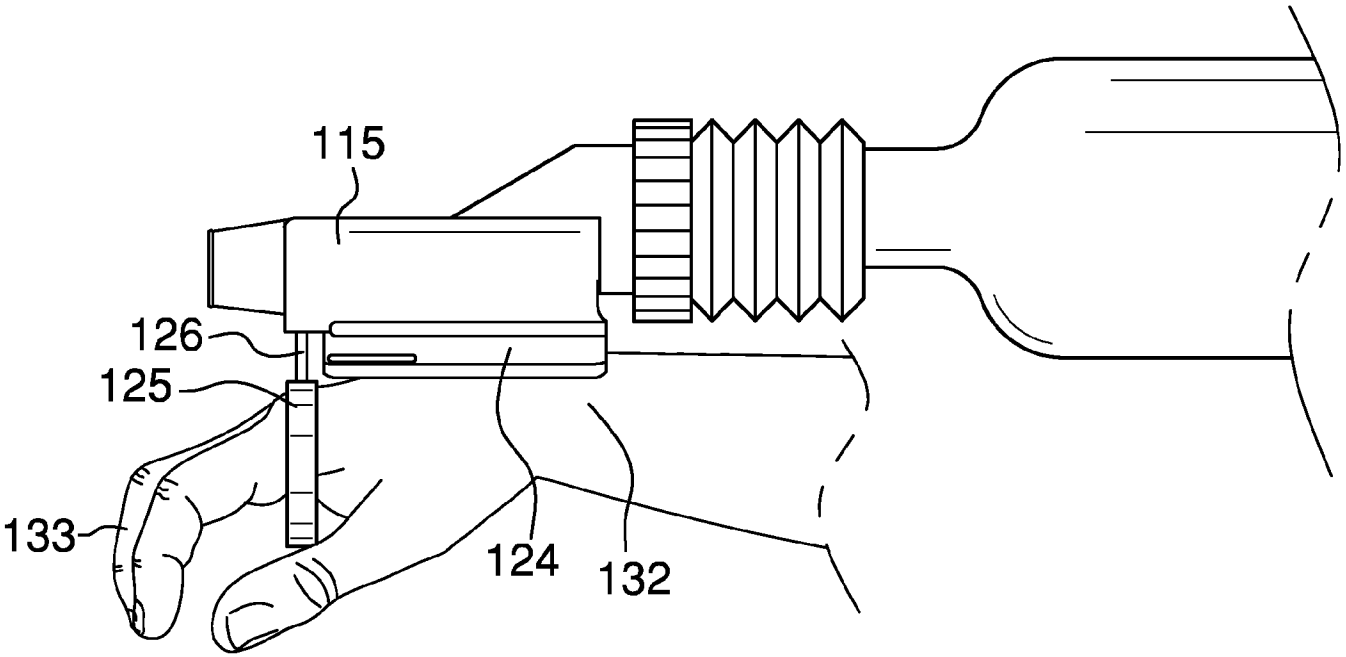
FIG. 8 is an in use view of an embodiment of the FIG. 9 is a detail view of an embodiment of the disclosure.
Figure 9:
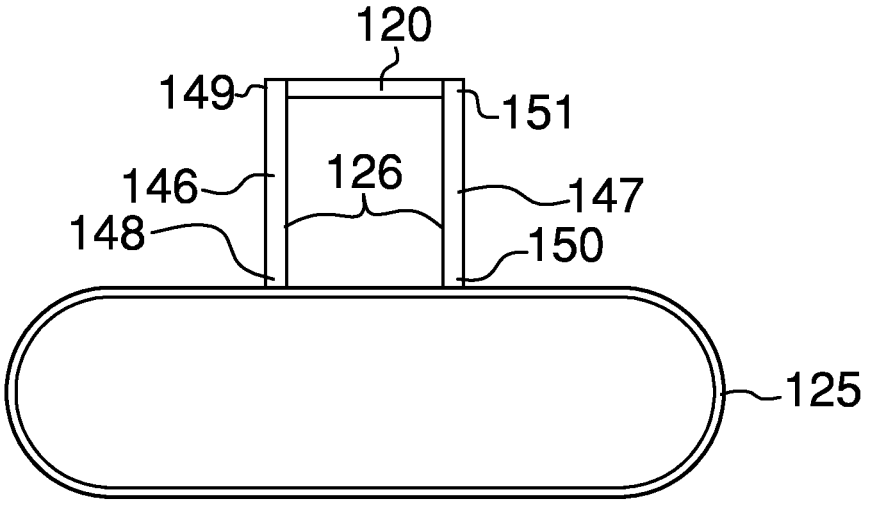

As shown most clearly in FIGS. 6 and 7, the adapter 114 further comprises an adapter shell 119, an offset cap 117, and an adjustable knob 118. The adapter shell 119 is a hollow cylinder that is attached to the spray assembly 102 at a location distal from the tip 116. The adapter shell 119 is attached to the spray assembly 102 such that the adapter shell 119 can be rotated around the first center axis 127 of the spray channel 115. Because the first center axis 127 of the spray channel 115 is offset from the second center axis 128 of the adapter shell 119, it is possible to move the adapter shell 119 out of the way of the arm 132. The adjustable knob 118 is used to rotate the adapter 114 around the adapter 114 around the first center axis 127. The adapter 114 is fitted with an offset cap 117. The offset cap 117 is a port that is sized to receive the threaded bottle neck 111. The interior surface of the offset cap 117 is formed with an interior screw thread that is sized to receive the exterior screw thread of the threaded bottle neck 111. The offset cap 117 is positioned such that the third center axis 129 of the bottle 101 is not aligned with the second center axis 128 of the adapter 114. This further allows the bottle 101 to be moved away from the arm 132. The adapter 114 is formed to allow the reservoir tube 112 to pass from the bottle 101 through the adapter 114 into the spray channel 115.

As shown most clearly in FIG. 6, the spray channel 115 further comprises a check valve 120, a plunger 121, and a plunger surface 122. The spray channel 115 is a hollow cylindrical tube that connects the adapter 114 to the tip 116. The spray channel 115 also houses the pump mechanism of the spray assembly 102. In the spray channel 115, the reservoir tube 112 enters the spray channel 115 from the adapter 114 and is terminated at the check valve 120. The check valve 120 is a ball valve that is installed to prevent the back flow of liquid 131 from the spray channel 115 back into the reservoir tube 112. The nozzle tube 113 is connected to the other side of the check valve 120 from the reservoir tube 112 in order to receive the liquid 131 delivered from the reservoir tube 112. The nozzle tube 113 is routed through the spray channel 115 so that the nozzle tube 113 runs between the plunger 121 and the plunger surface 122. The plunger surface 122 is a flat, plate-like surface that is placed in a fixed position within the spray can move relative to the plunger surface 122. The fourth face 144 of the plate-like surface of the plunger 121 is parallel to the fifth face 145 of the plate-like surface of the plunger surface 122. The operation of the plunger 121 and plunger surface 122 are discussed elsewhere in this disclosure.

The tip 116 further comprises a nozzle 123. The nozzle 123 is a hole that is formed through the tip 116. The nozzle 123 forms the channel through which the liquid 131 drawn from the bottle 101 is discharged. The nozzle tube 113 transports the liquid 131 received from the reservoir tube 112 to the nozzle 123. The nozzle tube 113 is terminated at the nozzle 123.

To operate the pump mechanism, the plunger 121 is moved towards the plunger surface 122. This movement compresses the nozzle tube 113 which compresses the liquid 131 contained within the nozzle tube 113. The compression of the liquid 131 within the nozzle tube 113 initially moves the liquid 131 within the nozzle tube 113 both toward the tip 116 and towards the check valve 120. However, the initial increase in pressure caused by the compression of the liquid 131 forces the check valve 120 shut. By shutting the check valve 120, all movement of liquid 131 through the nozzle tube 113 is through the nozzle 123 of the tip 116 which discharges the liquid 131 out of the spray assembly 102. After this discharge of liquid 131, when the the nozzle tube 113 which draws liquid 131 into the nozzle tube 113 through the check valve 120 from the reservoir tube 112. As a consequence, the reservoir tube 112 draws additional liquid 131 from the bottle 101.

The handle 125 further comprises a plurality of plunger shafts 126. The plurality of plunger shafts 126 further comprises a sixth shaft 146 and a seventh shaft 147. The sixth 146 shaft further comprises an eighth end 148 and a ninth end 149. The seventh shaft 147 further comprises a tenth shaft 150 and an eleventh shaft 151. The sixth shaft 146 and the seventh shaft 147 are attached to the handle 125. When the handle 125 is moved away from the spray channel 115, the plunger 121 is moved towards the plunger surface 122.

To use the invention 100, liquid 131 is placed in the bottle 101, the reservoir tube 112 is placed in the bottle 101 and the bottle 101 is attached to the spray assembly 102 by screwing the threaded bottle neck 111 into the offset cap 117. The back of hand rest 124 is placed on the arm 132 so that the palm of the hand 133 faces away from the invention 100. The hand 133 grips the handle 125. To operate the invention 100, the hand 133 pulls the handle 125 away from and then back towards the invention 100.

The following definitions were used in this disclosure:

Center Axis: As used in this disclosure, the center axis is the axis of a cylinder like structure. When the center axes of two cylinder like structures share the same line they are said to be aligned. When the center axes of two cylinder like structures do not share the same line they are said to be offset.

Exterior Screw Thread: An exterior screw thread is a ridge wrapped around the outer surface of a tube in the form of a helical structure that is used to convert rotational movement into linear movement.

Interior Screw Thread: An interior screw thread is a ridge wrapped around the inner surface of a tube in the form of a helical structure that is used to convert rotational movement into linear movement Pump: As used in this disclosure, a pump is a mechanical device that uses suction or pressure to raise or move liquids, compress gasses, or force a gas into an inflatable object.

Tube: As used in this disclosure, a tube is a hollow cylindrical device with a first open end and a second open end that is used for transporting liquids and gasses.

With respect to the above description, it is to be realized that the optimum dimensional relationship for the various components of the invention described above and in FIGS. 1 through 9, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A device for spraying liquids comprising:

a bottle and a spray assembly;

wherein the device for spraying liquids pumps liquid through a nozzle;

wherein the device for spraying liquids is manually operated;

wherein the device for spraying liquids is adapted to rest on an arm while in use;

wherein a back of hand rest is a curved structure that is adapted to rest against said arm;

wherein the spray assembly further comprises a trigger handle; wherein the handle encircles the fingers of a user's hand;

wherein a movement of the handle, by the user's fingers while the user's dorsal side of hand resting on the back of hand rest, powers a pump;

wherein the spray assembly further comprises a reservoir tube, a nozzle tube, an adapter, a spray channel, a tip, the back of hand rest, and the handle;

wherein the reservoir tube conducts liquid from the bottle to the spray channel;

wherein the nozzle tube conducts liquid from the reservoir tube to the tip;

wherein the nozzle tube is made from an elastic material;

wherein the adapter further comprises an adapter shell, an offset cap, and an adjustable knob;

wherein the adapter shell is a hollow cylinder that is attached to the spray assembly;

wherein the spray channel is further defined with a first center axis;

wherein the adapter shell is further defined with a second center axis;

wherein the bottle is further defined with a third center axis;

wherein the adapter shell is attached to the spray assembly such that the adapter shell can be rotated around the first center axis of the spray channel;

wherein the first center axis of the spray channel is offset from the second center axis of the adapter shell;

wherein the offset cap is a port that is sized to receive a threaded bottle neck;

wherein the offset cap is positioned such that the third center axis of the bottle is offset from the second center axis of the adapter;

wherein the adapter is formed to allow the reservoir tube to pass from the bottle through the adapter into the spray channel;

wherein the spray channel further comprises a check valve, a plunger, and a plunger surface;

wherein the spray channel is a hollow cylindrical tube that connects the adapter to the tip;

wherein the reservoir tube enters the spray channel from the adapter and is terminated at the check valve.

2. The device for spraying liquids according to claim 1 wherein the nozzle tube is connected to a side of the check valve distal from the reservoir tube.

3. The device for spraying liquids according to claim 2 wherein the nozzle tube is routed through the spray channel so that the nozzle tube runs between the plunger and the plunger surface.

4. The device for spraying liquids according to claim 3 wherein the tip is a device that discharges liquid from the spray assembly.

* * * * *